US007197909B1

(12) United States Patent
Haberman

(10) Patent No.: US 7,197,909 B1
(45) Date of Patent: Apr. 3, 2007

(54) PRESS UNLOADER

(75) Inventor: Kenneth D. Haberman, Nova, OH (US)

(73) Assignee: Ohio Valley Manufacturing, Inc., Mansfield, OH (US)

( * ) Notice: Subject to any disclaimer, the term of this patent is extended or adjusted under 35 U.S.C. 154(b) by 414 days.

(21) Appl. No.: 10/711,291

(22) Filed: Sep. 8, 2004

(51) Int. Cl.
*B21D 43/02* (2006.01)

(52) U.S. Cl. ..... 72/421; 72/426

(58) Field of Classification Search ..... 72/345, 72/361, 373, 419, 420, 421, 426, 428, 450; 100/218; 414/744.2, 749.1
See application file for complete search history.

(56) References Cited

U.S. PATENT DOCUMENTS

| | | | | | |
|---|---|---|---|---|---|
| 2,314,120 | A | * | 3/1943 | Braun | 72/345 |
| 2,693,159 | A | * | 11/1954 | Taylor | 72/426 |
| 3,148,571 | A | | 9/1964 | Wallis | |
| 3,349,602 | A | * | 10/1967 | Nelson | 72/426 |
| 3,653,293 | A | | 4/1972 | Wallis | |
| 3,707,908 | A | | 1/1973 | Merk et al. | |
| 3,753,489 | A | | 8/1973 | Tomioka et al. | |
| 3,756,107 | A | | 9/1973 | Pax et al. | |
| 3,893,358 | A | | 7/1975 | Dixon | |
| 3,918,280 | A | * | 11/1975 | Davis | 72/20.5 |
| 4,068,519 | A | | 1/1978 | Baringer | |
| 4,242,900 | A | | 1/1981 | Dixon | |
| 4,634,338 | A | | 1/1987 | Tsuge et al. | |
| 4,637,243 | A | | 1/1987 | Bond | |
| 5,245,900 | A | | 9/1993 | Dognik | |
| 5,572,926 | A | | 11/1996 | Bachhuber | |
| 5,983,762 | A | | 11/1999 | Chen et al. | |
| 6,109,087 | A | | 8/2000 | Yoshii et al. | |

FOREIGN PATENT DOCUMENTS

| | | | |
|---|---|---|---|
| JP | 61-38728 | * | 2/1986 |
| JP | 62-89537 | * | 4/1987 |

* cited by examiner

*Primary Examiner*—Ed Tolan
(74) *Attorney, Agent, or Firm*—Christopher L. Parmelee; Walker & Jocke LPA

(57) ABSTRACT

A press unloader is provided for unloading parts from a press. The unloader comprises at least one arm. The arm is operative to rotate responsive to rotation of a shaft into and out of the press between an internal position between the dies of the press and an external position that is not between the dies of the press. The shaft may be driven by a drive linkage connected to an upper portion of the press and may rotate responsive to the up and down motion of the upper portion of the press. The arm may be comprised of lower and upper portions in pivoting connection with each other. A guide member is operative to cause the angle between the upper portion and lower portion of the at least one arm to become relatively wider at the internal position and to become relatively narrower at the external position.

20 Claims, 5 Drawing Sheets

PRESS UNLOADER

TECHNICAL FIELD

This invention relates to material handling equipment. Specifically this invention relates to press unloaders for use with automatically removing parts from a press.

BACKGROUND ART

Stamping presses for manufacturing metal parts are well known. Such stamping presses typically include a lower and an upper die. The lower die is typically held stationary while the upper die is moved up and down between a lower position and an upper position. While the upper die moves between the lower and upper positions, a workpiece (also referred to herein as a part or article) is inserted between the dies. As the upper die moves downwardly to its lower position, the workpiece is urged (i.e. stamped) with sufficient force into a new shape which corresponds to the contour of the upper and lower dies. After the workpiece is stamped, the upper die moves upwardly and the stamped workpiece is removed from the press and replaced by a new unstamped workpiece.

Although the stamped workpiece may be manually removed, an unloader is typically used to automatically remove the stamped workpiece from between the dies. Such unloaders may include a ramp which is inserted between the dies of the stamping press. The stamped workpiece is typically lifted upwardly with the upper die and is released from the die when the upper portion of the unloader is directly beneath stamped workpiece. Upon being released, the stamped workpiece slides down the ramp to a position outside of the press where it is collected by a bin, conveyor system or other article collection device.

Unfortunately many unloaders may only be practical for use with presses with a relatively long stroke in which the dies of the press separate a sufficient amount to enable the top of the ramp to fit between the dies. Ramps may not be as practical for use in presses with a shorter stroke in which the dies have relatively shorter maximum separation during each cycle of the press. Presses with a relatively shorter stroke may have dimensions which prohibit the ramp from having an angle which is sufficiency steep to consistently direct the stamped workpiece to an article collection device. As a result the stamped workpiece may not slide properly down the ramp, and the press may require maintenance to manually remove the stamped workpiece from the press. Downtime associated with correcting a problem with an unloader may reduce the overall productivity of the press and increase the costs associated with the manufacture of a workpiece.

Thus there exists a need for a new system and method of unloading a workpiece from a press which maximizes the uptime associated with the press. There further exists a need for a new system and method of unloading a workpiece from a press which minimizes the occurrence of the workpiece not being properly removed from the press. There further exists a need for a new system and method of unloading a workpiece from a press which can accommodate presses with a relatively short stroke.

Press unloaders may include a complex arrangement of gears and other parts. Such complexity may require a significant amount of time to install, configure and maintain the unloader, which may further decrease the productively of the press. Further, unloaders may have a size and shape which reduces the visibility of the press by an operator of the press. As a result, an operator may not be able to visually detect problems which are occurring with a press. Consequently there exists a need for an unloader which is capable of being installed and configured on a press in a relatively short amount of time. Further there exists a need for an unloader which minimizes the reduction in visibility of the press caused by the unloader.

DISCLOSURE OF INVENTION

It is an object of an exemplary form of the present invention to provide an improved press unloader for automatically removing a stamped workpiece from a press.

It is a further object of an exemplary form of the present invention to provide a press unloader which maximizes the uptime associated with the press.

It is a further object of an exemplary form of the present invention to provide a press unloader which maximizes the productivity associated with the press.

It is a further object of an exemplary form of the present invention to provide a press unloader which can be used with presses with a relatively short stroke.

It is a further object of an exemplary form of the present invention to provide a press unloader which is capable of being installed and configured for a press in a relatively short amount of time.

It is a further object of an exemplary form of the present invention to provide a press unloader which minimizes the reduction in visibility of the press caused by the presence of the unloader.

Further objects of exemplary forms of the present invention will be made apparent in the following Best Modes for Carrying Out Invention and the appended claims.

The foregoing objects may be accomplished in an exemplary embodiment by a press unloader that includes at least one arm which reciprocates into and out of a press responsive to movement of an upper portion of the press. In this described exemplary embodiment a base of the unloader may be placed adjacent a lower portion of the press. The unloader may include a drive linkage which may be placed in operative connection with the upper portion of a press. The up and down reciprocating motion of the upper portion of the press is operative to cause the drive linkage to rotate a shaft of the unloader through a plurality of clockwise and counterclockwise motions.

In the exemplary embodiment, the at least one arm of the unloader is in operative connection with the shaft. Responsive to the rotation of the shaft, the at least one arm is operative to reciprocate between an internal position where a portion of the at least one arm is between the dies of the press and an external position where the portion of the at least one arm is not between the dies of the press. A slope of the upper portion of the at least one arm at the external position is greater than the slope of the of the upper portion of the at least one arm at the internal position. As a result a stamped part dropped on to the upper portion of the at least one arm is operative to slide down the arm and away from the press as the unloader moves from the internal position to the external position.

In the exemplary embodiment, the at least one arm includes a lower portion in pivoting connection with an upper portion of the at least one arm at a first location on the upper portion of the at least one arm. The lower portion of the at least one arm is in operative connection with the shaft and is operative to rotate responsive to rotation of the shaft.

The exemplary embodiment of the unloader may include at least one guide member which is operative to cause the angle between the upper portion and lower portion of the at least one arm to be relatively wider at the internal position of the at least one arm and to become relatively narrower at the external position of the at least one arm. The at least one guide member may include a first end in pivoting connection with the base at a pivot point adjacent the base. The pivot point may be spaced apart from the shaft. In addition, the at least one guide member may include a second end in pivoting connection with the upper portion of the at least one arm at a second location on the upper portion of the at least one arm. In the exemplary embodiment, the first location and the second location are spaced apart on the upper portion of the at least one arm.

Also, in an exemplary embodiment, the distance between the first location on the upper portion of the at least one arm and the second location on the upper portion of the at least one arm is greater than the length of a line which extends radially from the axis of rotation of the shaft to the pivot point adjacent the base about which the at least one guide member pivots.

In addition, in an exemplary embodiment, the drive linkage may be in operative connection with the shaft at a first location on the shaft while the at least one arm may be in operative connection with the shaft at a second location on the shaft. In this described exemplary embodiment, the first location on the shaft is spaced apart from the second location on the shaft along a longitudinal axis of the shaft.

In an exemplary embodiment, when the upper portion of the press is at a maximum height for each cycle, the at least one arm is at the internal position. Also, when the upper portion of the press is at a minimum height for each cycle, the at least one arm is at the external position. The at least one portion of the upper portion of the at least one arm moves through a path between the internal position and the external position of the at least one arm. In an exemplary embodiment, the at least one portion of the upper portion of the at least one arm may be at a lowest vertical position of the path at the external position of the at least one arm.

BEST MODES FOR CARRYING OUT INVENTION

Figure 1:
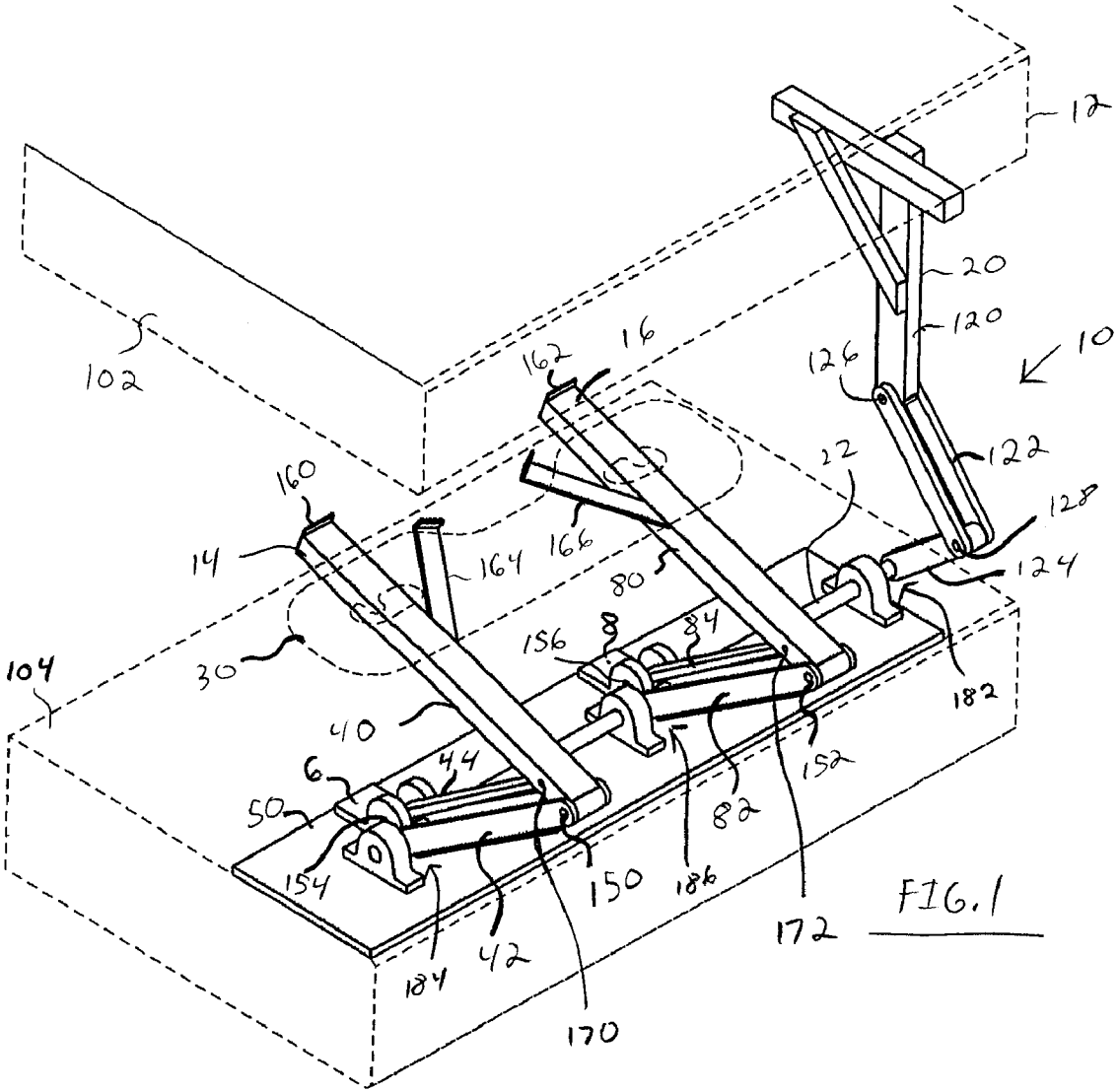
FIG. 1 is a perspective view representative of an exemplary embodiment of an unloader for a press.
Figure 2:
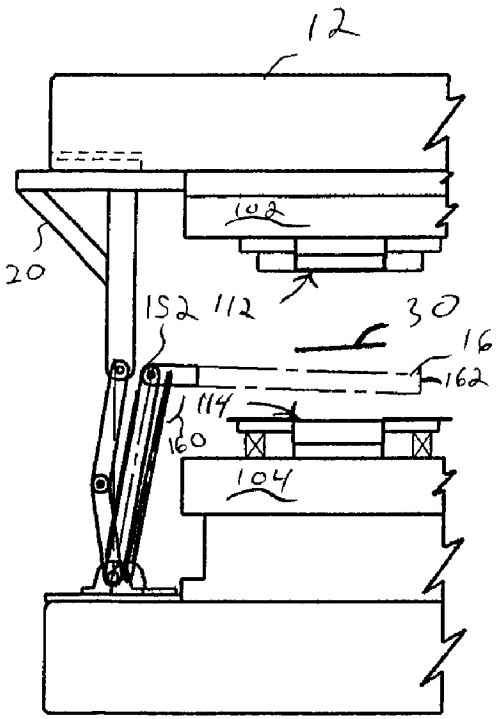
FIGS. 2–5 show side plan views of the unloader at different positions in time as the arms of the unloader move a part from the press.
Figure 3:
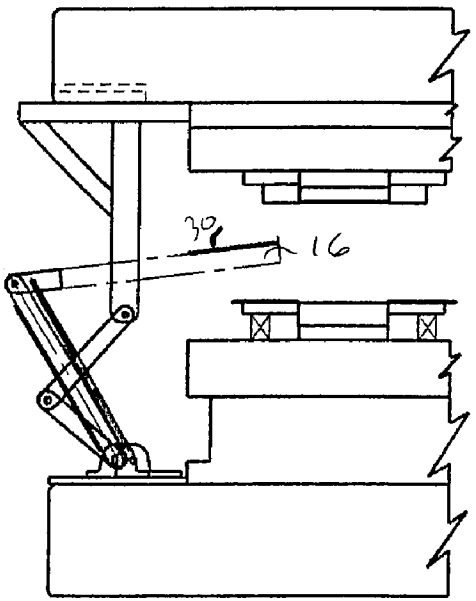
Figure 4:
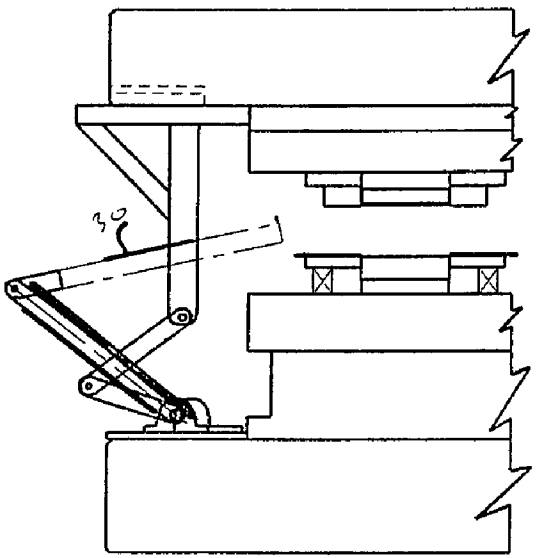

Referring now to the drawings and particularly to FIG. 1, there is shown therein a perspective view of an exemplary embodiment of a press unloader 10. Here the unloader 10 is shown in operative connection with a stamping press 12. The unloader may include one or more arms 14, 16, a tray, and/or other projection which moves in a reciprocating motion between an internal position and an external position relative the dies of the press. In the internal position, the arms 14, 16 of the unloader are operative to receive a stamped part 30 that is dropped from the upper portion 102 of the press. The unloader then moves from the internal position to the external position to move the stamped part 30 from out between the dies of the press as the press stamps the next part. After the next part is stamped, the unloader operates to move from the external position back to the internal position to receive the next stamped part. After receiving the next part, the unloader then moves back to the external position to remove the part from the press. This cycle continues for each part stamped by the press.

FIGS. 2–5 show the unloader at constitutive points in time for a portion of one cycle of the press. In an exemplary embodiment, when the arms are at the internal position (shown in FIG. 2) at least a portion of the arms extend between an upper die 112 of an upper portion 102 of the press and a lower die 114 of a lower portion 104 of the press 12. When the arms are at the external position (shown in FIG. 5) all portions of the arms are positioned outwardly of the dies 112, 114.

In this described exemplary embodiment the arms move from the external position to the internal position during a first time period when the upper portion 102 of the press moves the upper die 112 upwardly with respect to the lower die 114. In addition, in this described exemplary embodiment, the arms move from the internal position to the external position during a time period when the upper portion 102 of the press moves the upper die 112 downwardly to stamp a part adjacent the lower die 114.

In an exemplary embodiment, the unloader reaches the internal position when the upper portion of the unloader has reached its maximum height with respect to the lower portion of the press. Also, in the exemplary embodiment, the unloader reaches the external position when the upper portion of the unloader reaches its minimum height with respect to the lower portion of the press.

In one exemplary embodiment, the reciprocating motion of the unloader is driven by the movement of the upper portion 102 of the press. As shown in FIG. 1, a drive linkage 20 may be connected to the upper portion 102 of the press so that the drive linkage is operative to move up and down responsive to the motion of the upper portion of the press.

In this described exemplary embodiment, the drive linkage 20 may be comprised of an upper portion 120, a middle portion 122, and a lower portion 124. The upper portion and middle portion 122 may be in hinged connection at a first pivot point 126. Also, the middle portion 122 and lower portion 124 may be in hinged connection at a second pivot point 128.

In an exemplary embodiment, the unloader further includes a horizontal shaft 22. The lower portion 124 of the drive linkage may be connected to the shaft such that movement of the lower portion 124 of the drive linkage causes the shaft to rotate. Thus, when the upper portion 120 of the drive linkage 20 moves up and down, the lower portion 124 of the drive linkage is operative to urge the shaft 22 to rotate clockwise and counterclockwise, respectively.

In this described exemplary embodiment, the shaft may be coupled to the arms 14, 16 of the unloader and may cause the arms to move between the internal and external positions responsive to the clockwise and counterclockwise rotations, respectively, of the shaft.

The arms may include an upper portion 40, 80 in pivoting connection with a lower portion 42, 82 at pivot points 150, 152. The lower portions 42, 82 of each arm may be connected to the shaft so that they rotate as the shaft rotates. In the exemplary embodiment, the drive linkage 20 is in operative connection with the shaft at a first location on the shaft. The lower portions 42, 82 of the arms are in operative connection with the shaft at locations 184, 186. The locations 184, 186 of the arms on the shaft are spaced apart in a common direction from the first location on the shaft along the longitudinal axis of the shaft. In an exemplary embodiment, the drive linkage is spaced part from the arms a sufficient distance along the shaft to provide an operator of the press with an unobstructed view of the arms of the unloader and the area of the press directly above the arms of the unloader when standing adjacent the arms of the unloader.

In an exemplary embodiment, the unloader may include guide members 44, 84. The guide members 44, 84 may be in pivoting connection with a base of the device 50 at pivot points 154, 156. The guide members 44, 84 may also be in pivoting connection with the upper portions 40, 80 respectively of the arms at pivot points 170, 172. Here the pivot points 170, 172 of the guide members are located on the upper portions 40, 80 of the arms at positions which are spaced apart from the pivot points 150, 152 between the lower and upper portions of the arms. In addition, the pivot points 154, 156 are located on the base 50 at positions which are spaced apart from the shaft.

In an exemplary embodiment, the minimum distance between the axis of the shaft and each pivot point 154, 156 on the base is shorter than the minimum distance between the pivot points 170, 172 and the pivot points 150, 152, respectively, on each arm. However, in other exemplary embodiments, other orientations between the guide members 44, 84 and the lower portion of the arms be used.

In the exemplary embodiment, as the shaft 22 rotates, the shaft 22 causes the lower portions 42, 82 of the arms to rotate as well. In addition, as the lower portions 42, 82 of the arms rotate, the upper portions 40, 80 of the arms are urged by the lower portions 42, 82 of the arms to rotate. In addition, as the lower portions 42, 82 of the arms rotate, the guide members 44, 84 are operative to cause the upper portions 40, 80 of the arms to change their relative angular position with respect to the lower portions 42, 82 of the arms.

Referring to FIGS. 2 to 5, this arrangement of the arms and guide members are operative to causes the angles 160 between the upper and lower portions of the arms to decrease from the internal position to the external position (FIGS. 2 to 5) thereby minimizing the height the arms reach when being drawn out from between the dies 112, 114. By minimizing the maximum height the arms reach when moving from the internal position to the external position, the unloader may be used in presses which have a relatively short stroke (i.e. maximum vertical distance between dies of the press).

In addition, as the arms move from the internal position to the external position, the ends of the upper portions of the arms which include the pivot points 150, 152 travel a relatively longer downwardly vertical distance than the ends 160, 162 of the upper portions of the arms. As a result, the upper portions of the arms go from a generally horizontal or at least a minimally sloped orientation (at FIG. 2) to a relatively steeper sloped orientation (at FIG. 5). Movement of the upper portion of the arms to the steeper sloped orientation and gravity are operative to cause a part 30 to slide off of the arms and away from the press to an article collection device. Examples of an article collection device may include a bin, conveyor or other storage or transport system usable to collect parts removed from the press.

Figure 5:
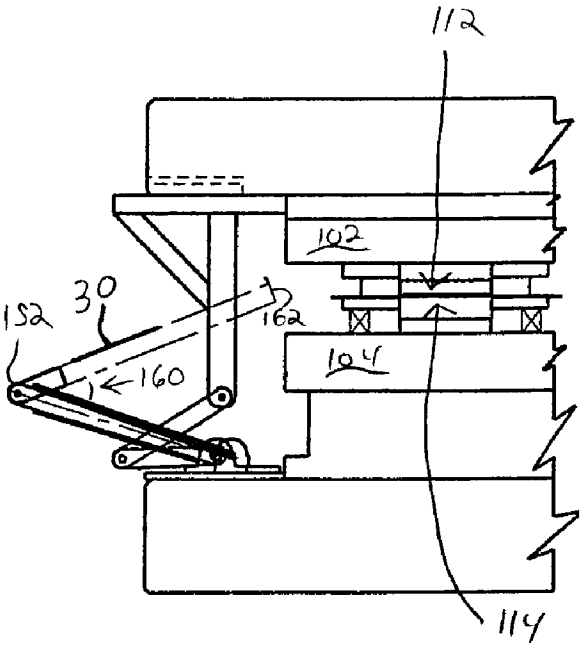
Figure 8:
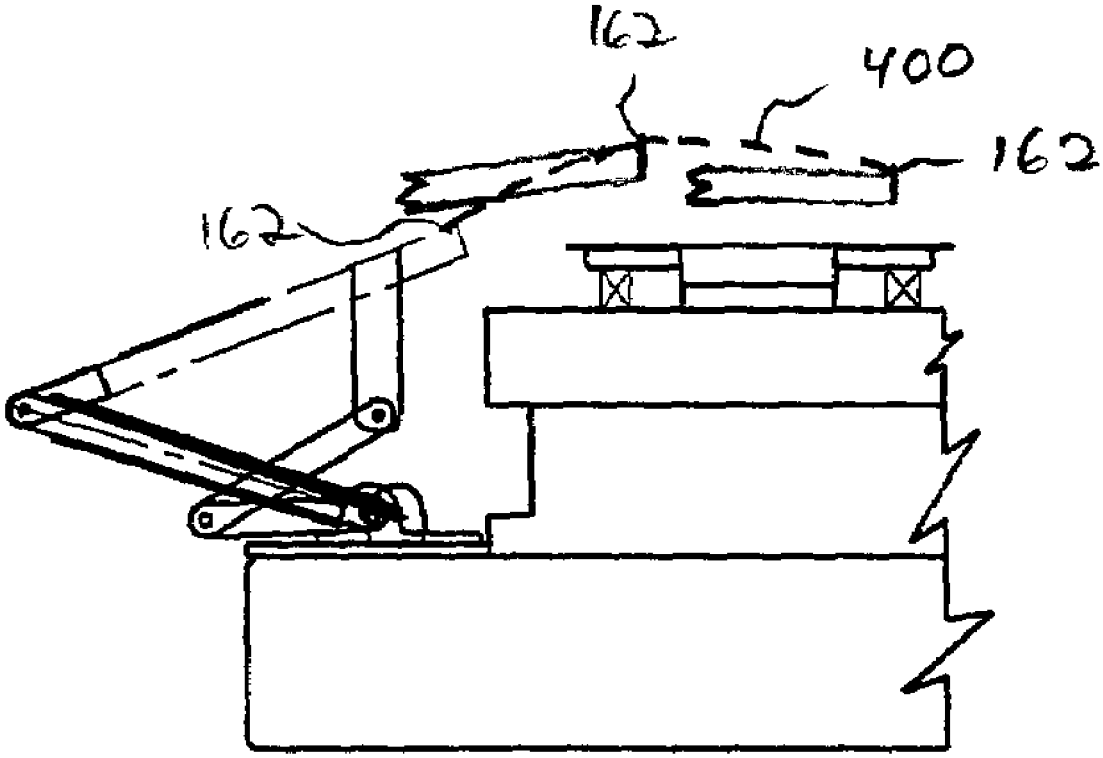
FIG. 8 is a side plan view showing the path through which the ends of the arms move.

In this described exemplary embodiment, the relative orientation and configurations of the drive linkage, shaft, arms, and guide members are further operative to cause the ends 160, 162 of the upper portions of the arms to move through a path 400 (FIG. 8) in which the upper ends 160, 162 move vertically downwardly to their lowest vertical position when the unloader is in the external position (See FIG. 5).

In this described exemplary embodiment, the upper portions of the arms are operative to remain relatively level and minimally sloped while portions of the arms are within or near the dies of the press. However, as the arms approach the external position, the slope of the upper portion of the arms are operative to increase significantly to cause the part to slide away from the press. This motion of the upper ends of the arms 160, 162, enables the unloader to be used with presses which have a relatively narrow amount of clearance between the upper and lower portions 102, 104 of the press, when the dies 112, 114 of the press are brought together to stamp a part.

In addition, as shown in FIG. 1, the relative orientation and configurations of the drive linkage, shaft, arms, and guide members are further operative to maximize the amount of visibility an operator of the press may have with respect to the area between the dies. By having the ends of the arms 60, 62 move to their lowest vertical position at the external position of the unloader, the operator of the press can view the part as it is being stamped with minimal visual interference from the arms of the unloader.

In exemplary embodiments, pivot points 154, 156 of the guide members may be mounted to adjustable blocks 6, 8 (FIG. 1) which permit the distances between the shaft 22 and pivot points 154, 156 to be increased or decreased. In an exemplary embodiment the blocks and base may include cooperating slots, tracks, grooves, projections or other guide elements which enable the pivot points 6, 8 to move in directions which extend normal to the shaft. After adjustment, the blocks 6, 8 may be secured in place to the base with bolts or other fasteners. By adjusting the position of the pivot points 154 with respect to the shaft, the path through which the arms move therethrough may be adjusted to conform to the geometry of a particular press.

In the described exemplary embodiment, the unloader includes two arms which move in parallel into and out of the area between the dies of the press. In alternative exemplary embodiments a single arm may be used.

Figure 6:
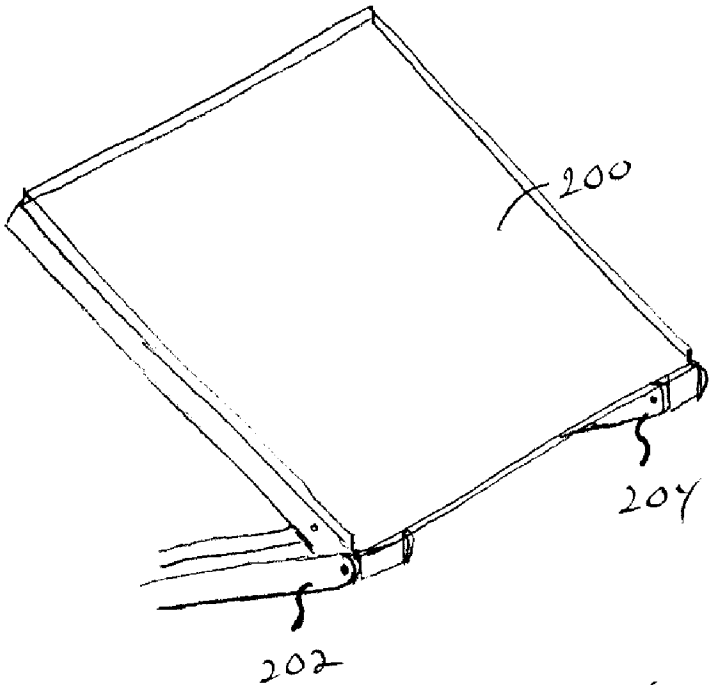
FIG. 6 is a perspective view representative of an alternative exemplary embodiment of an unloader that includes a tray.

As shown in FIG. 1, in exemplary embodiments, the arms 14, 16 may include fingers or other projections or guide members which are operative to minimize the opportunity for a part 30 to fall between the arms. In further alternative exemplary embodiments, the unloader may include a tray in operative connection with a single arm or a tray 200 which extends between the two parallel arms 202, 204 (FIG. 6).

In exemplary embodiments, the unloader and/or press may include sensors which are operative to detect the location of the part at one or more times during each cycle of the press. Such sensors may be coupled to a circuit, processor or other controller which controls the operation of the press. If a sensor indicates that a part has failed to drop onto the unloader, a controller circuit may be responsive to the sensor to stop the press.

In exemplary embodiments, the base of the unloader may be adapted to enable the guide members, shaft, and arms of the unloader to be mounted in different relative locations on the base. When the unloader is being setup for use with a particular press, the relative locations of the drive linkage, arms and shaft may be adjusted on the base to enable the arms to move through an appropriate motion for unloading parts from the press.

Also, in exemplary embodiments, one or more of the upper and lower arm portions 40, 80, 42, 82 and guide members 44, 84 may be adjustable in length and/or replaceable with arm portions or drive linkage portions of different lengths based on the size and configuration of a press.

In addition, in exemplary embodiments, the lower portion of the drive linkage may be adjustable or replaceable with another lower portion with a different length so as to adjust the amount of angular rotation through which the shaft moves during a cycle of the press.

Figure 7:
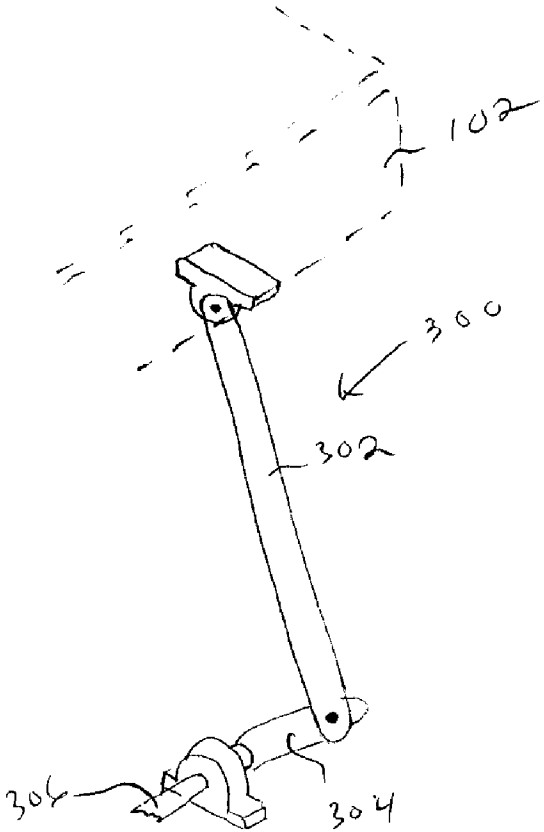
FIG. 7 is a perspective view of an alternative exemplary embodiment of a drive linkage between an upper portion of the press and a shaft of the unloader.

In further alternative exemplary embodiments, rather than having a drive linkage 20 with all three of an upper potion 120, middle portion 122, and lower portion 124, an alternative exemplary embodiment of the drive linkage 300, as shown in FIG. 7, may include only an upper portion 302 and a lower portion 304 in pivoting connection with each other. Here the upper portion of the drive linkage 302 may be mounted in pivoting connection to the upper portion 102 of the press. The lower portion 304 of the drive linkage may be mounted in operative connection with the shaft 306 of the unloader.

In the exemplary embodiment, the guide members 44, 84 are located adjacent the side of the lower portions 42, 82 of the arms which face the dies of the press. However, in alternative exemplary embodiments, the guide members 44, 84 may be located adjacent the opposite side of the lower portions 42, 82.

Thus the new press unloader achieves one or more of the above stated objectives, eliminates difficulties encountered in the use of prior devices and systems, solves problems and attains the desirable results described herein.

In the foregoing description certain terms have been used for brevity, clarity and understanding; however, no unnecessary limitations are to be implied therefrom because such terms are used for descriptive purposes and are intended to be broadly construed. Moreover, the descriptions and illustrations herein are by way of examples, and the invention is not limited to the exact details shown and described.

In the following claims any feature described as a means for performing a function shall be construed as encompassing any means known to those skilled in the art to be capable of performing the recited function, and shall not be limited to the features and structures shown herein or mere equivalents thereof. The description of the exemplary embodiment included in the Abstract included herewith shall not be deemed to limit the invention to features described therein.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

What is claimed is:

1. An apparatus comprising:

a press unloader, wherein the press unloader comprises:

a base;

a shaft in rotatable connection with the base;

at least one arm extending from the shaft in a radial direction, wherein the at least one arm includes an upper portion and a lower portion, wherein the lower portion of the at last one arm includes a first end and a second end, wherein the first end of the lower portion of the at least one arm is in operative connection with the shaft and is operative to rotate responsive to rotation of the shaft, wherein the second end of the lower portion of the at least one arm is in pivoting connection with the upper portion of the at least one arm at a first location on the upper portion of the at least one arm;

at least one guide member, wherein the guide member includes a first end and a second end, wherein the first end of the guide member is operative to pivot about a pivot point positioned adjacent the base, wherein the pivot point is spaced apart from the shaft, wherein the second end of the guide member is in pivoting connection with the upper portion of the at least one arm at a second location on the upper portion of the at least one arm, wherein the first location on the upper portion of the at least one arm is spaced apart from the second location on the upper portion of the at least one arm;

a drive linkage, wherein the drive linkage includes at least two portions in pivoting connection with each other, wherein a first one of the at least two portions of the drive linkage is in operative connection with the shaft, wherein the second one of the at least two portions of the drive linkage is adapted to be connected to an upper portion of a press, wherein as the upper portion of the press moves through a plurality of up and down cycles, the drive linkage is operative to cause the shaft to rotate, whereby the rotation of the shaft causes the at least one arm to reciprocate between an internal position relative dies of the press and an external position relative the dies of the press.

2. The apparatus according to claim 1, further comprising:

the press, wherein the press includes a lower portion and the upper portion, wherein the press includes a first die in operative connection with the lower portion and a second die in operative connection with the upper portion, wherein movement of the upper portion of the press through a plurality of up and down cycles with respect to the lower portion of the press is operative to cause the at least one arm to reciprocate between the internal and the external positions, wherein at the internal position, at least one portion of the upper portion of the at least one arm is located between the first die and the second die, wherein at the external position, the at least one portion of the upper portion of the at least one arm is not located between the first die and the second die.

3. The apparatus according to claim 2, wherein the first one of the at least two portions of the drive linkage is in operative connection with the shaft at a first location on the shaft, wherein the lower portion of the at least one arm is in operative connection with the shaft at a second location on the shaft, wherein the first location on the shaft is spaced apart from the second location on the shaft along a longitudinal axis of the shaft.

4. The apparatus according to claim 2, wherein the distance between the first location on the upper portion of the at least one arm and the second location on the upper portion of the at least one arm is greater than a length of a line that extends radially from a rotational axis of the shaft to the pivot point adjacent the base about which the at least one guide member pivots.

5. The apparatus according to claim 2, wherein when the upper portion of the press is at a maximum height for each cycle, the at least one arm is at the internal position, wherein when the upper portion of the press is at a minimum height for each cycle, the at least one arm is at the external position, wherein the at least one portion of the upper portion of the at least one arm moves through a path between the internal position and the external position of the at least one arm, wherein the at least one portion of the upper portion of the at least one arm is at a lowest vertical position of the path at the external position of the at least one arm.

6. The apparatus according to claim 5, wherein a slope of the upper portion of the at least one arm at the external position is greater than the slope of the of the upper portion of the at least one arm at the internal position, wherein an angle between the upper portion and lower portion of the at least one arm is relatively wider at the internal position of the at least one arm and is relatively narrower at the external position of the at least one arm.

7. The apparatus according to claim 2, wherein the second one of the at least two portions of the drive linkage is in pivoting connection with the upper portion of the press.

8. The apparatus according to claim 1, further comprising at least two parallel arms in operative connection with the shaft.

9. The apparatus according to claim 1, further comprising at least one finger in operative connection with the upper portion of the at least one arm.

10. The apparatus according to claim 1, further comprising at least one tray in operative connection with the upper portion of the at least one arm.

11. An apparatus comprising:

a press, wherein the press comprises a lower portion and an upper portion, wherein the press includes a first die in operative connection with the lower portion and a second die in operative connection with the upper portion, wherein the upper portion of the press is operative to move through a plurality of up and down cycles with respect to the lower portion of the press and stamp parts between the first and second dies;

an unloader, wherein the unloader comprises:

a shaft in rotatable connection the lower portion of the press;

at least one arm extending from the shaft in a radial direction, wherein the at least one arm includes an upper portion and a lower portion, wherein the lower portion of the at last one arm includes a first end and a second end, wherein the first end of the lower portion of the at least one arm is in operative connection with the shaft and is operative to rotate responsive to rotation of the shaft, wherein the second end of the lower portion of the at least one arm is in pivoting connection with the upper portion of the at least one arm at a first location on the upper portion of the at least one arm;

at least one guide member, wherein the guide member includes a first end and a second end, wherein the first end of the guide member is in pivoting connection with a pivot point, wherein the pivot point is adjacent the lower portion of the press, wherein the pivot point is spaced apart from the shaft, wherein the second end of the guide member is in pivoting connection with the upper portion of the at least one arm at a second location on the upper portion of the at least one arm, wherein the first location on the upper portion of the at least one arm is spaced apart from the second location on the upper portion of the at least one arm;

a drive linkage, wherein the drive linkage includes at least two portions in pivoting connection with each other, wherein a first one of the at least two portions is in operative connection with the shaft, wherein the second one of the at least two portions is in operative connection with the upper portion of the press, wherein movement of the upper portion of the press is operative to cause the at least one arm to reciprocate between an internal position and an external position, wherein at the internal position, at least one portion of the upper portion of the at least one arm is located between the first die and the second die, wherein at the external position, the at least one portion of the upper portion of the at least one arm is not located between the first die and the second die.

12. The apparatus according to claim 11, wherein the first one of the at least two portions of the drive linkage is in operative connection with the shaft at a first location on the shaft, wherein the lower portion of the at least one arm is in operative connection with the shaft at a second location on the shaft, wherein the first location on the shaft is spaced apart from the second location on the shaft along a longitudinal axis of the shaft.

13. The apparatus according to claim 11, wherein the distance between the first location on the upper portion of the at least one arm and the second location on the upper portion of the at least one arm is greater than a length of a line that extends radially from a rotational axis of the shaft to the pivot point adjacent the lower portion of the press about which the at least one guide member pivots.

14. The apparatus according to claim 11, wherein when the upper portion of the press is at a maximum height for each cycle, the at least one arm is at the internal position, wherein when the upper portion of the press is at a minimum height for each cycle, the at least one arm is at the external position, wherein the at least one portion of the upper portion of the at least one arm moves through a path between the internal position and the external position of the at least one arm, wherein the at least one portion of the upper portion of the at least one arm is at a lowest vertical position of the path at the external position of the at least one arm.

15. The apparatus according to claim 11, wherein a slope of the upper portion of the at least one arm at the external position is greater than the slope of the of the upper portion of the at least one arm at the internal position, wherein an angle between the upper portion and lower portion of the at least one arm is relatively wider at the internal position of the at least one arm and is relatively narrower at the external position of the at least one arm.

16. A method comprising:

a) placing a base of an unloader adjacent a lower portion of a press, wherein the lower portion of the press includes a first die;

b) placing a drive linkage of the unloader in operative connection with an upper portion of a press, wherein the upper portion of the press includes a second die;

c) reciprocating the upper portion of the press through a plurality of up and down cycles with respect the lower portion of the press;

d) driving a shaft of the unloader to rotate with the drive linkage through a plurality of clockwise and counterclockwise motions responsive to the reciprocation of the upper portion of the press in (c);

e) reciprocating at least one arm in operative connection with the shaft between an internal position and an external position responsive to the rotation of the shaft in (c), wherein the at least one arm includes a lower portion in pivoting connection with an upper portion of the at least one arm at a first location on the upper portion of the at least one arm, wherein the lower portion of the at least one arm is in operative connection with the shaft and is operative to rotate responsive to rotation of the shaft, wherein in the internal position at least one portion of the upper portion of the at least one arm is located between the first and second dies, wherein in the external position the at least one portion of the upper portion of the at least one arm is not located between the first and second dies;

f) causing with at least one guide member of the unloader, the angle between the upper portion and lower portion of the at least one arm to become relatively wider at the internal position of the at least one arm and to become relatively narrower at the external position of the at least one arm, wherein the at least one guide member includes a first end in pivoting connection with the base at a pivot point adjacent the base, wherein the pivot point is spaced apart from the shaft, wherein the at least one guide member includes a second end in pivoting connection with the upper portion of the at least one arm at a second location on the upper portion of the at least one arm, wherein the first location and the second location are spaced apart on the upper portion of the at least one arm.

17. The method according to claim 16, wherein in (d) the drive linkage is in operative connection with the shaft at a first location on the shaft, wherein in (e) the lower portion of the at least one arm is in operative connection with the shaft at a second location on the shaft, wherein the first location on the shaft is spaced apart from the second location on the shaft along a longitudinal axis of the shaft.

18. The method according to claim 16, wherein the distance between the first location on the upper portion of the at least one arm and the second location on the upper portion of the at least one arm is greater than a length of a line that extends radially from a rotational axis of the shaft to the pivot point adjacent the base about which the at least one guide member pivots.

19. The method according to claim 16, wherein in (e) when the upper portion of the press is at a maximum height for each cycle, the at least one arm is at the internal position, wherein when the upper portion of the press is at a minimum height for each cycle, the at least one arm is at the external position, wherein the at least one portion of the upper portion of the at least one arm moves through a path between the internal position and the external position of the at least one arm, wherein the at least one portion of the upper portion of the at least one arm is at a lowest vertical position of the path at the external position of the at least one arm.

20. The method according to claim 16, wherein in (e) a slope of the upper portion of the at least one arm at the external position is greater than the slope of the of the upper portion of the at least one arm at the internal position.

* * * * *